US005488776A

United States Patent [19]

Schoenefeld

[11] Patent Number: 5,488,776

[45] Date of Patent: Feb. 6, 1996

[54] METHOD AND APPARATUS FOR MODIFYING TRANSMISSION HOUSING

[76] Inventor: Bruce D. Schoenefeld, R.R. 3, Box 53A, Kearney, Nebr. 68847

[21] Appl. No.: 287,215

[22] Filed: Aug. 8, 1994

[51] Int. Cl.[6] ..... B43L 9/00

[52] U.S. Cl. ..... 33/21.1; 33/42

[58] Field of Search ..... 33/21.1, 21.2, 33/21.3, 21.4, 27.03, 42

[56] References Cited

U.S. PATENT DOCUMENTS

| | | | |
|---|---|---|---|
| 2,464,444 | 3/1949 | Gantz . | |
| 2,474,041 | 6/1949 | Dimmock | 33/27.03 |
| 3,111,761 | 11/1963 | McAlister | 33/27.03 |
| 3,228,112 | 1/1966 | Hanks . | |
| 4,159,573 | 7/1979 | Plihal . | |
| 4,241,506 | 12/1980 | LeBlanc et al. | 33/27.03 |
| 4,393,594 | 7/1983 | Hoffman et al. | 33/203.16 |
| 4,553,305 | 11/1985 | Dearman . | |
| 4,793,066 | 12/1988 | Cheng . | |
| 4,934,058 | 6/1990 | Gibson | 33/42 |
| 5,040,299 | 8/1991 | Hwang | 33/27.03 |

FOREIGN PATENT DOCUMENTS

| | | | |
|---|---|---|---|
| 0008441 | 3/1956 | Germany | 33/21.1 |

*Primary Examiner*—Alvin Wirthlin

*Attorney, Agent, or Firm*—Zarley, McKee, Thomte, Voorhees & Sease; Mark D. Frederiksen

[57] ABSTRACT

A scribe tool includes an elongated horizontal support member with connector plates at each end adapted for attachment to the block end of a transmission housing. An elongated strap is pivotally connected to the center of the support member for pivotal movement through a vertical plane parallel to the support member. A scribe arm on the upper end of the strap includes a forward leg with a pointed lower end for scribing a material, and a rearward leg slidably journaled in a sleeve on the upper end of the strap to permit radial movement of the scribe arm relative to the pivotal axis of the strap, and also permit pivotal movement of the scribe arm with the strap. The sleeve has a truncated cylindrical aperture therethrough for receiving the base leg which matches the shape of the base leg, to prevent rotational movement of the base leg while permitting radial movement of the scribe arm.

4 Claims, 2 Drawing Sheets

METHOD AND APPARATUS FOR MODIFYING TRANSMISSION HOUSING

TECHNICAL FIELD

The present invention relates generally to automobile transmissions, and more particularly to a method and tool utilized in modifying a transmission housing to receive an overdrive transmission.

BACKGROUND OF THE INVENTION

Chevrolet designed an overdrive transmission, namely, the 700 R4, specifically for a Chevrolet engine and specifically for a specific Chevrolet bolt pattern in the transmission housing. The 700 R4 and 4L80-E transmissions were favored when introduced because of the advantage of thirty percent overdrive, and the advantage of a lower first gear ratio of 3.06 to 1.00.

Subsequent Chevrolet transmission housings, as well as other transmission housings for General Motors vehicles, including Oldsmobile, Pontiac, Cadillac, and Buick, have a transmission case with a different bolt pattern, and thus would not permit use of the advantageous 700 R4 or 4L80-E transmissions.

SUMMARY OF THE INVENTION

It is therefore a general object of the present invention to provide an apparatus for modifying a transmission housing to receive a 700 R4 or 4L80-E transmission.

A further object of the present invention is to provide an improved method for modifying a transmission housing to receive a specific overdrive transmission.

These and other objects will be apparent to those skilled in the art.

The scribe tool of the present invention includes an elongated horizontal support member with connector plates at each end adapted for attachment to the block end of a transmission housing. An elongated strap is pivotally connected to the center of the support member for pivotal movement through a vertical plane parallel to the support member. A scribe arm on the upper end of the strap includes a forward leg with a pointed lower end for scribing a material, and a rearward leg slidably journaled in a sleeve on the upper end of the strap to permit radial movement of the scribe arm relative to the pivotal axis of the strap, and also permit pivotal movement of the scribe arm with the strap. The sleeve has a truncated cylindrical aperture therethrough for receiving the base leg which matches the shape of the base leg, to prevent rotational movement of the base leg while permitting radial movement of the scribe arm.

DESCRIPTION OF THE PREFERRED EMBODIMENT

Figure 1:
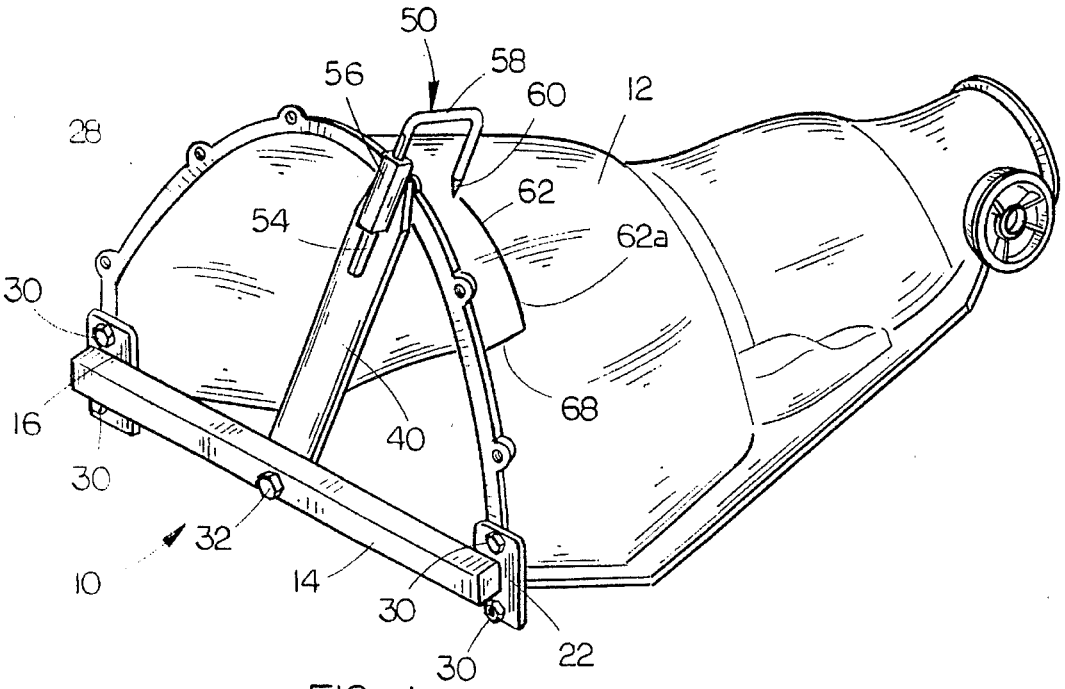
FIG. 1 is a perspective view of the scribing tool of the present invention connected to a standard non-overdrive transmission housing.

Referring now to the drawings, in which similar or corresponding parts are identified with the same reference numeral, and more particularly to FIG. 1, the scriber tool of the present invention is designated generally at 10 and is shown connected to a standard or non-overdrive transmission housing 12 for use.

Figure 2:
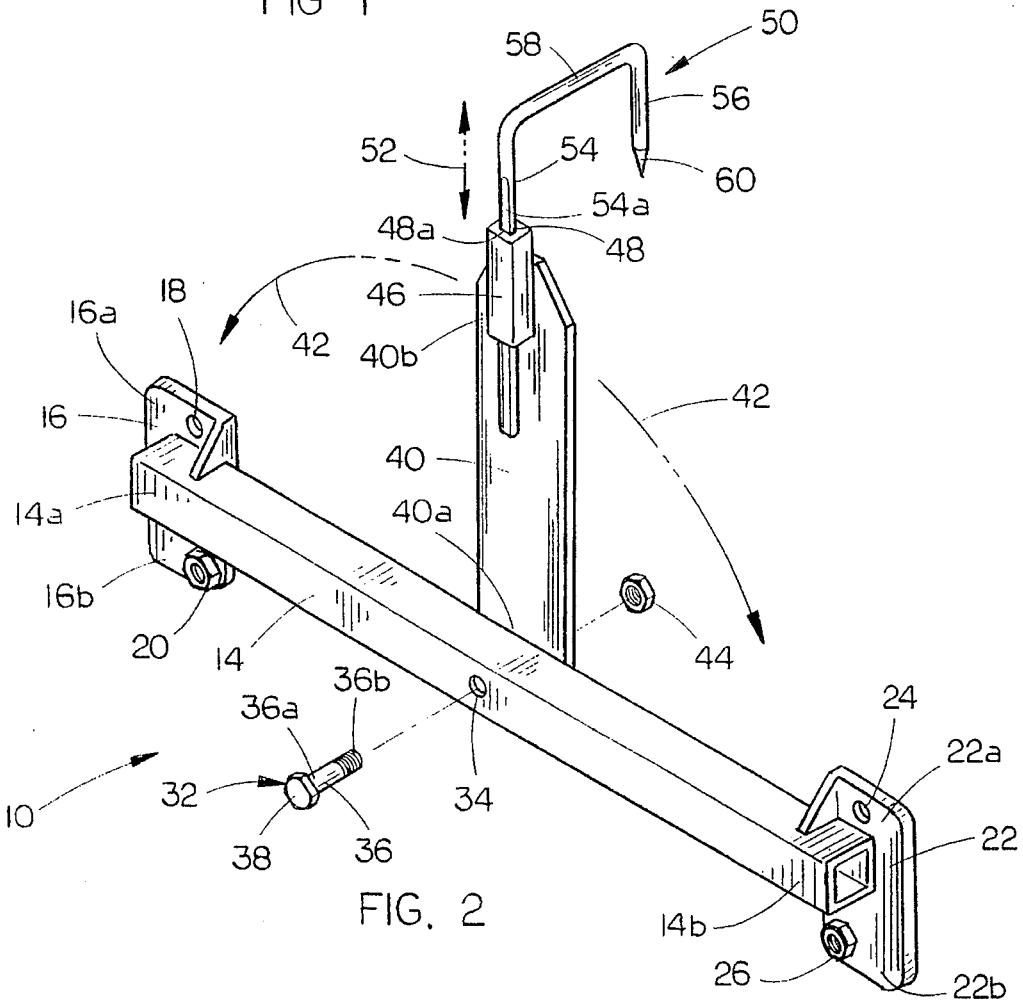
FIG. 2 is a perspective view of the scribing of the present invention.

Referring now to FIG. 2, scriber tool 10 includes an elongated support member 14 having opposing ends 14*a* and 14*b*. Support member end 14*a* includes a vertically oriented connector plate 16 affixed thereto with an upper end 16*a* projecting upwardly beyond support member 14, and a lower end 16*b* projecting downwardly beyond support member 14. An aperture 18 is formed in the upper end 16*a* of connector 16, while a lower aperture is formed in lower end 16*b* of connector plate 16 directly below upper aperture 18. A nut 20 is mounted to the lower end 16*b* of connector plate 16 coaxial with the lower aperture to receive the end of a bolt, as described in more detail below.

The opposite end 14*b* of support member 14 also has a connector plate 22 mounted vertically thereon, with an upper end 22*a* and a lower end 22*b* projecting upwardly and downwardly, respectively, past support member 14. Connector plate 22 also includes an upper aperture 24 in the upper end 22*a* thereof, and a nut 26 mounted coaxially with a lower aperture in the connector plate lower end 22*b*.

As shown in FIG. 1, connector plates 16 and 22 are mounted on support arm 14 such that the upper and lower apertures of the connector plates are aligned with bolt holes formed in the flange 28 at one end of transmission housing 12. In this way, bolts 30 may be journaled through the connector plates 16 and 22 to mount scriber 10 to flange 28 of transmission housing 12.

A pivot pin 32 is journaled through an aperture 34 in support member 14, centrally located between ends 14*a* and 14*b* and extending horizontally through support member 14. Pivot pin 32 includes a shank 36 with an unthreaded portion 36*a* and a threaded end 36*b* opposite a head 38. An elongated rigid strap 40 has an aperture in the lower end which receives the unthreaded portion 36*a* of pivot pin 32 therethrough, to permit strap 40 to pivot above pivot pin 32 within a vertical plan as indicated by arrows 42. A nut 44 is secured to the threaded end 36*b* of pivot pin 32 to retain strap 40 in pivotal position on pin 32.

A sleeve 46 is affixed to the upper end 40*b* of strap 40 with a central tubular aperture 48 aligned radially from pivot pin 32. As shown in FIG. 2*a*, sleeve aperture 48 has a flattened longitudinal side 48a, forming a longitudinally truncated cylindrical shape.

A scriber arm 50 is slidably mounted in sleeve aperture 48 for vertical movement, as indicated by arrow 52. Scribe arm 50 includes a base leg 54 having a vertically and longitudinally extending flattened portion 54*a* extending along its length, to fit the cross-sectional shape of sleeve aperture 48 and permit vertical slidable movement but prevent rotational movement about the longitudinal axis of base leg 54. A forward leg 56 of scribe arm 50 is connected at an upper end to the upper end of base leg 54 by a cross-member 58 projecting forwardly from the upper end of base leg 54. The lower end of leg 56 has a pointed end 60 which may be used to scribe metal.

Referring once again to FIG. 1, it can be seen that strap 40 permits pivotal movement of scribe arm 50 about pivot pin 32, while the slidable connection of base leg 54 within sleeve 46 permits radial movement of scribe arm 50 towards and away from pivot pin 32 while maintaining cross-member 58 parallel to the pivotal axis of pivot pin 32. In this way, the scribe tool 10 may be utilized to scribe a line 62 parallel to flange 28 yet able to adjust for transmission housings having different heights and curvatures.

Figure 3:
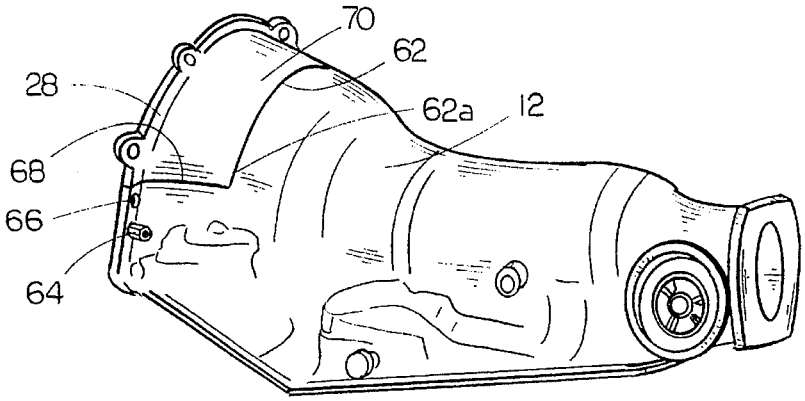
FIG. 3 is a perspective view of a standard transmission housing showing the first modification step of the method of the invention.

The process for modifying a standard transmission housing 12 to receive an overdrive type transmission, such as the 700 R4 or 4L80-E includes the first step of attaching scribe tool 10 to the flange 28 of standard transmission housing 12 using bolts 30 journaled through the lower two dowel holes 64 and lower two bolt holes 66, as shown in FIG. 3. The pointed end 60 of scribe arm 50 is then moved into contact with housing 12 and strap 40 is pivoted on pivot pin 32 to form a scribe line 62 extending parallel to flange 28 and from side to side on housing 12 as shown in FIG. 1. It should be noted that base leg 54 and flattened portion **54*a* thereof, serve to retain scribe arm 50 oriented orthogonally relative to the vertical plane of flange 28, such that scribe line 62 is parallel to flange 28. Once scribe line 62 has been completed, scribe tool 10 is removed from housing 12 and a second line 68 is scribed onto housing 12 at a 90° angle from one end 62*a* of first scribe line 62, to flange 28. A similar end scribe line is scribed on the opposite side of housing 12 directly opposed to scribe line 68**.

Figure 4:
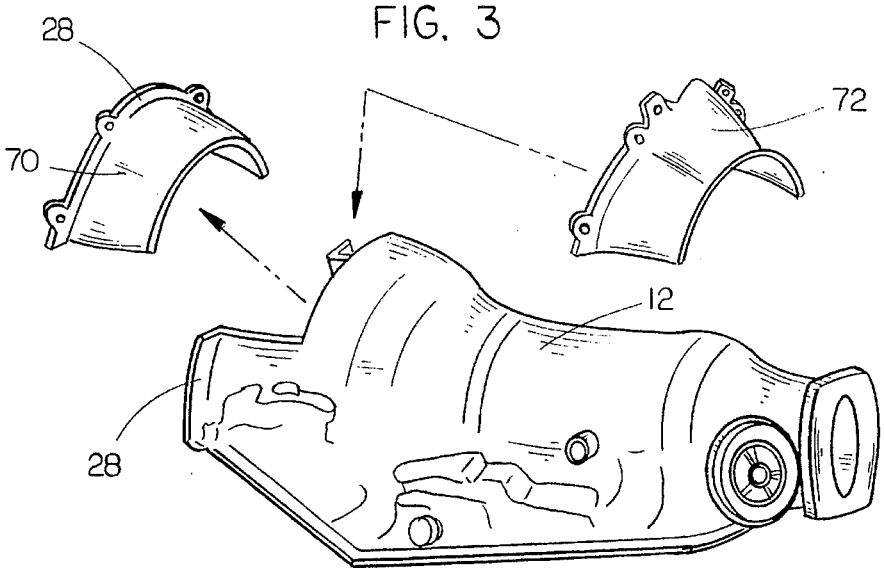
FIG. 4 is a view similar to FIG. 3, showing a second step in the method of the invention.

A saw is then utilized to cut along the first scribe line 62 and the two transverse scribe lines 68 to cut out an arch-shaped section 70 of housing 12, including a portion of flange 28, as shown in FIGS. 3 and 4. Scribe tool 10 is then attached to a donor transmission case (not shown) and the same procedure is followed to obtain an arch-shaped section 72, as shown in FIG. 4, to replace section 70 from the original housing 12. Section 72 is removed from a transmission housing which will receive the desired overdrive transmission.

Figure 5:
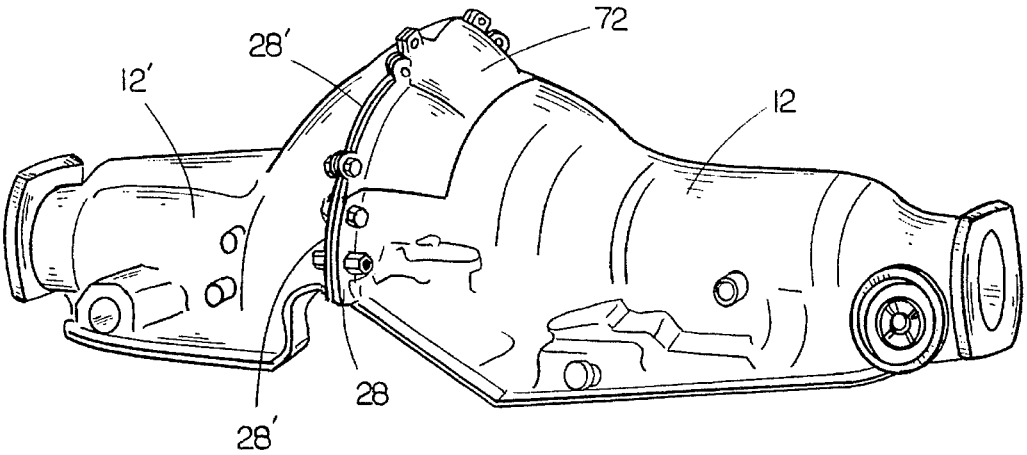
FIG. 5 is a perspective view similar to FIG. 4 showing a third step in the method of the invention.

Referring now to FIG. 5, a jig assembly is formed utilizing an old junk block, or a second transmission case 12'. Transmission cases 12 and 12' are bolted together along flanges 28 and 28' to firmly retain the cases in affixed position. The donor section 72 is then bolted to flange 28' of second case 12' to affix section 72 in perfect alignment with the remainder of housing 12. Donor section 72 is then welded to case 12, both inside and out, and allowed to cool. The jig case 12' is then unbolted from housing 12, and the block side of the connection between donor section 72 and housing 12 is welded along flange 28. Flange 28 is then ground off and filed on the block side to make the surface flush along flange 28.

Whereas the method and apparatus of the present invention has been shown and described in connection with the preferred embodiment thereof, it should be understood that many modifications, substitutions and additions may be made which are within the intended broad scope of the appended claims.

I claim:

1. A scribe tool, comprising:

an elongated horizontal support member having first and second longitudinal ends and forward and rearward sides;

each of said support member ends having means thereon for removably attaching the support member to an object to be scribed;

an elongated strap pivotally connected at a lower end to the forward side of the support member centrally between the ends thereof for pivotal movement in a vertical plane parallel to the support member; and a scribe arm operably connected to an upper end of the strap for pivotal movement with the strap and for radial movement relative to the pivotal axis of the strap;

said scribe arm including a forward leg having a pointed lower end for scribing material, a base leg operably connected to the strap; and a cross-member connecting the forward and base legs, the forward leg mounted parallel to the base leg for radial movement with the base leg.

2. The scribe tool of claim 1, further comprising a sleeve mounted on the upper end of said strap, said sleeve having a tubular aperture therethrough with an axis radial to the pivotal axis of the strap, and wherein said scribe base leg is slidably mounted through said sleeve aperture for radial movement therethrough.

3. The scribe tool of claim 2, further comprising means on said sleeve for preventing rotational movement of the base leg about the radial axis of the sleeve aperture while simultaneously permitting radial movement of the base leg through the sleeve aperture, and wherein said cross-member projects forwardly from and generally perpendicular to the base leg.

4. The scribe tool of claim 3, wherein said means for preventing rotational movement of the base leg includes:

said base leg having a cylindrical shape truncated longitudinally to form a flattened portion; and said sleeve aperture having a truncated cylindrical shape corresponding with the base leg shape to permit slidable radial movement of the base leg but prevent rotation movement thereof.

* * * * *